United States Patent [19]

Taylor

[11] 4,063,734

[45] Dec. 20, 1977

[54] BOARD GAME APPARATUS

[76] Inventor: Edward G. Taylor, 100 Oxford Drive, Monroeville, Pa. 15146

[21] Appl. No.: 759,652

[22] Filed: Jan. 17, 1977

[51] Int. Cl.[2] ..... A63F 3/00

[52] U.S. Cl. ..... 273/131 AD; 273/131 BA; 273/131 D; 273/131 E; 273/131 K

[58] Field of Search ..... 273/130, 131, 134, 136

[56] References Cited

U.S. PATENT DOCUMENTS

| | | | |
|---|---|---|---|
| 519,041 | 5/1894 | Hoffman | 273/131 BA |
| 534,080 | 2/1895 | Preston | 273/131 BA |
| 1,215,154 | 2/1917 | Horvitz | 273/131 BA |
| 1,499,214 | 6/1924 | Griebel | 273/131 BA |
| 3,565,436 | 2/1971 | Opmeer | 273/130 D |

*Primary Examiner*—Delbert B. Lowe
*Attorney, Agent, or Firm*—Buell, Blenko & Ziesenheim

[57] ABSTRACT

A game and gameboard for two players comprising a flat board surface having thereon a play field having holding means adapted to receiving playing pieces of two colors representing two players, a pair of adjacent record fields in the form of smaller replicas of the play field having holding means adapted to receive record pieces in the form of smaller replicas of the playing pieces to record the completion of a selected series of moves on the play field representing a winning series for a player and a pair of lines of numbered holding means on opposite sides of the board adapted to receive the said record pieces to tally a player's number of winning games.

7 Claims, 1 Drawing Figure

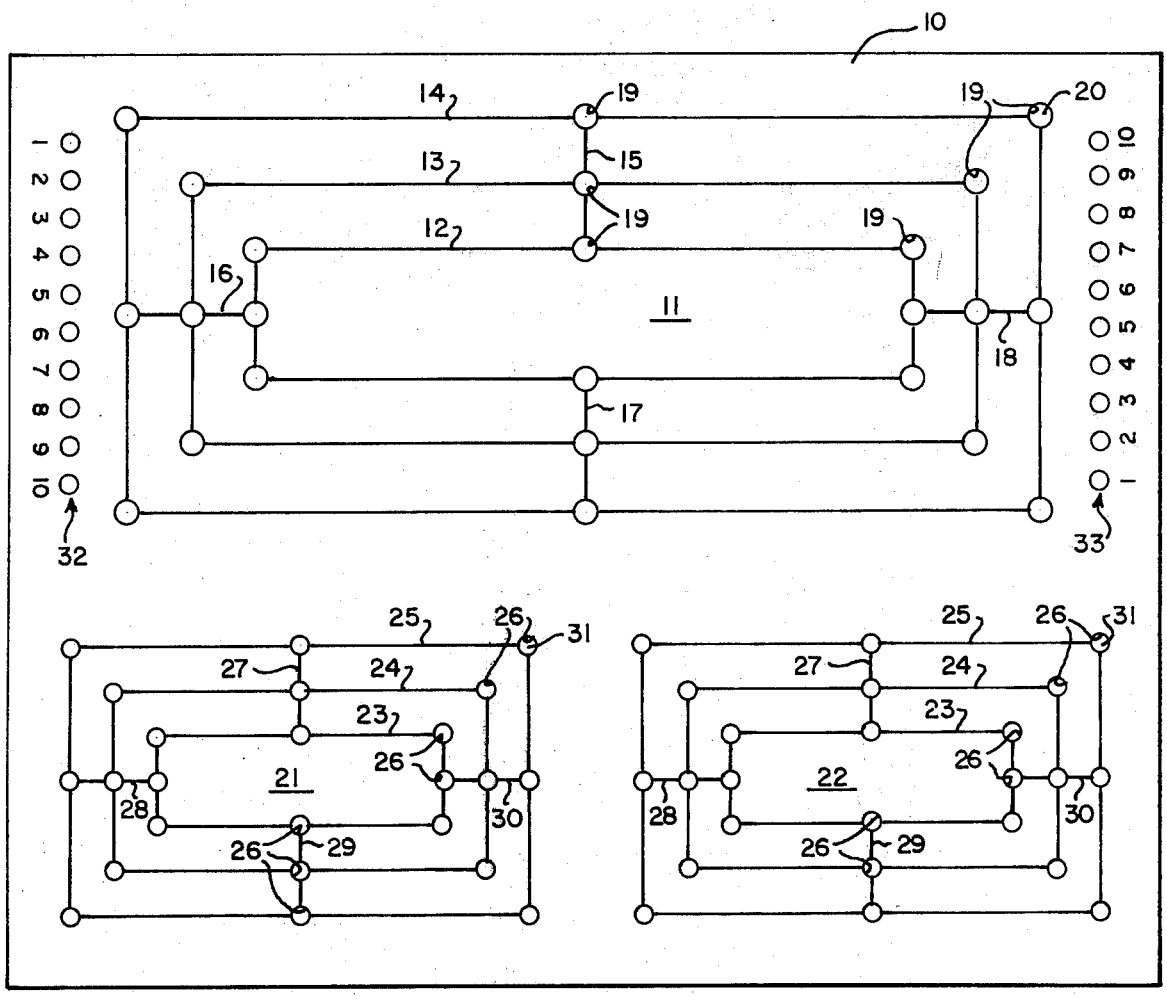
10
11
12
13
14
15
16
17
18
19
20
21
22
23
24
25
26
27
28
29
30
31
32
33
1 2 3 4 5 6 7 8 9 10

BOARD GAME APPARATUS

This invention relates to game apparatus and particularly to game apparatus for two players which include a gameboard having a main playing field of three concentric rectangles, and a pair of different smaller record fields, one for each player. The main playing field has holding means such as an opening at each corner of each rectangle and holding means such as an opening intermediate each side between said corners for receiving a playing piece. Each record field has an identical arrangement of holding means such as holes for receiving smaller like record pieces. The playing pieces and record pieces are of two identical colors, one for each player. Nine playing pieces are provided in each color and 20 record pieces are provided in each color. A pair of numbered rows of holding means such as openings are provided for receiving record pieces on opposite sides of the board for recording the wins of each player.

Two players play the game on the game apparatus of this invention. The game will be described using a board having openings as the holding means, with the playing pieces having a peg portion inserted into the openings. Each player plays with nine play pegs (large) and places one peg at a time in any of the vacant Main Field holes which he elects, the two players taking turns with the objective being to line up three pegs of the same color, either horizontally or vertically on the Main Field. When a player succeeds in placing three pegs of his color in alignment as described above, he completes what I have elected to call a "Maison" and is entitled to remove from the Main Field one peg of his opponent, however, he may remove only a peg which does not constitute a part of a "Maison". Once all pegs are placed on the gameboard, the game continues by moving one peg at a time into the next vacant hole over the marked course on the Main Field in any direction, which is not occupied by a peg. Jumping over another peg or pegs is not permitted. The players take turns throughout this game until one player is reduced to having three pegs and his opponent makes a "Maison" in nine moves or less, counting both players' moves, but, if that player cannot make a "Maison" in a maximum of nine moves, the game is tied and each player counts the game as a win. Each time a "Maison" is achieved, the player marks the location of that "Maison" in his corresponding record area with the correspondingly colored small pegs. This records each "Maison" of each game and a repetition of the same "Maison" in the same location will not count as a scoring move although a player may, if he chooses, repeat a "Maison" but he is not entitled to remove his opponent's peg nor record it in the record field. Once the game is over, the winning player inserts a small peg of his color in one of the numbered holes along the side of the board indicating the number of games he or she has won. The loser starts the next game.

The game can be used as a tournament wherein several games are played at the same time, as for instance, in Duplicate Bridge, on separate gameboards.

In the foregoing general description, I have outlined my new gameboard and game and its objects, purposes and advantages. Other objects, purposes and advantages will be obvious from a consideration of the following description and the accompanying drawing which shows a top plan view of the gameboard of my invention.

Referring to the drawing, I have illustrated a gameboard 10 having outlined thereon a Main or Play Field 11, having three concentric rectangles 12, 13 and 14 connected intermediate their corners by transverse lines 15, 16, 17 and 18. Each corner of each rectangle 12, 13 and 14 is provided with an opening 19 to receive a play peg 20. The intersection of each rectangle 12, 13 and 14 with transverse lines 15, 16, 17 and 18 is also provided with a like opening 19 to receive a play peg 20. Two Record Fields 21 and 22 are provided on the board adjacent the Main or Play Field 11. These Record Fields 21 and 22 are smaller replicas of the Main or Play Field 11, each having three concentric rectangles 23, 24 and 25 with holes 26 at each corner and transverse lines 27, 28, 29 and 30 intersecting the sides of the rectangles intermediate the corners and provided with holes 26 at each intersection of the rectangles and transverse lines. Small replicas (record pegs) 31 of the play pegs 20 are adapted to be inserted in holes 26. Finally, there are provided two lines of numbered holes 32 and 33 along opposite sides of board 10. These holes 32 and 33 are identical to holes 26 and are adapted to receive the record pegs 31.

As pointed out above, there are provided eighteen play pegs 20, nine of one color, e.g., white and nine of another contrasting color, e.g., black and 20 record pegs 26 of each such color, forty in all.

The holding means can be magnetic inserts in the board, with metal portions on the playing pieces to be held in place or it could be any other suitable means for releasably holding the playing pieces.

The manner in which the game is played, recorded and tallied is set out fully above and no further detailed description is believed necessary.

I have, in the foregoing specification, set out certain preferred practices and embodiments of my invention, however, it will be understood that this invention may be otherwise embodied within the scope of the following claims.

I claim:

1. A gameboard comprising a flat board surface having thereon a play field having holding means adapted to receiving playing pieces of two colors representing two players, a pair of adjacent record fields in the form of smaller replicas of the play field having holding means adapted to receive record pieces in the form of smaller replicas of the playing pieces to record the completion of a selected series of moves on the play field representing a winning series for a player and a pair of lines of numbered holding means on opposite sides of the board adapted to receive the said record pieces to tally a player's number of winning games.

2. A gameboard as claimed in claim 1 wherein the holding means are openings in the board receiving peg projections on the playing pieces.

3. A gameboard as claimed in claim 2 wherein each of the play field and the record fields have three concentric rectangles with openings at each corner and four transverse lines intermediate the corners with openings at the intersection of the transverse lines and rectangles.

4. A gameboard as claimed in claim 2 having a series of nine play pegs of each of two colors and a series of twenty record pegs of each of said two colors, said pegs being adapted for insertion in the openings of the play field and the record field respectively.

5. A game for two players comprising a flat board surface having thereon a play field having holding means adapted to receive playing pieces of two colors representing two players, a pair of adjacent record fields in the form of smaller replicas of the play field having holding means adapted to receive record pieces in the form of smaller replicas of the playing pieces to record the completion of a selected series of moves on the play field representing a winning series for a player and a pair of lines of numbered holding means on opposite sides of the board adapted to receive the said record pegs to tally a player's number of winning games, a series of nine play pieces of each of two colors, one color for each player, and a series of 20 record pieces of each of said two colors, said pieces being adapted for insertion on the play field and the record fields respectively.

6. A game as claimed in claim 5 wherein the holding means are openings in the board receiving peg projections on the playing pieces.

7. A game as claimed in claim 5 wherein each of the play field and the record fields have three concentric rectangles with openings at each corner and four transverse lines intermediate the corners with openings at the intersection of the transverse lines and rectangles.

* * * * *

UNITED STATES PATENT OFFICE

CERTIFICATE OF CORRECTION

Patent No. 4,063,734 Dated December 20, 1977

Inventor(s) EDWARD G. TAYLOR

It is certified that error appears in the above-identified patent and that said Letters Patent are hereby corrected as shown below:

Column 1, line 7, "different" should read --identical--.

Column 1, line 15, "identical" should read --different--

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*